US008538304B2

(12) United States Patent
Wakana et al.

(10) Patent No.: US 8,538,304 B2
(45) Date of Patent: Sep. 17, 2013

(54) BELT DRIVE APPARATUS AND IMAGE FORMING APPARATUS

(75) Inventors: Takashi Wakana, Tokyo (JP); Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 269 days.

(21) Appl. No.: 12/946,010

(22) Filed: Nov. 15, 2010

(65) Prior Publication Data

US 2011/0116847 A1 May 19, 2011

(30) Foreign Application Priority Data

Nov. 16, 2009 (JP) ..... 2009-261250

(51) Int. Cl.
*G03G 15/20* (2006.01)

(52) U.S. Cl.
USPC ..... 399/313

(58) Field of Classification Search
USPC ..... 399/312, 213, 316, 381; 198/806, 198/807
See application file for complete search history.

(56) References Cited

U.S. PATENT DOCUMENTS 4,286,706 A * 9/1981 Castelli et al. ..... 198/806
6,002,908 A * 12/1999 Hayashi et al. ..... 399/312
2008/0311505 A1* 12/2008 Akioka ..... 430/114

FOREIGN PATENT DOCUMENTS

JP 06-100195 A 4/1994
JP 2006-065056 A 3/2006
JP 2006-162659 A 6/2006

* cited by examiner

*Primary Examiner* — Walter L Lindsay, Jr.
*Assistant Examiner* — Barnabas Fekete
(74) *Attorney, Agent, or Firm* — Marvin A. Motsenbocker; Mots Law, PLLC

(57) ABSTRACT

A belt drive apparatus includes: a rotatable first roller; a rotatable second roller; a belt member stretched by the first and the second rollers so as to be capable of being conveyed by the first roller and the second roller; and a restraint member provided on at least one of the two ends of the second roller and including a belt receiving surface to be brought into contact with an edge portion of the belt member. The belt receiving surface and an axis of the second roller make an angle that is not smaller than 93° but not larger than 115°.

13 Claims, 10 Drawing Sheets

BELT DRIVE APPARATUS AND IMAGE FORMING APPARATUS

CROSS REFERENCE TO RELATED APPLICATIONS

This application claims priority based on 35 USC 119 from prior Japanese Patent Application No. P2009-261250 filed on Nov. 16, 2009, entitled "BELT DRIVE APPARATUS AND IMAGE FORMING APPARATUS", the entire contents of which are incorporated herein by reference.

BACKGROUND OF THE INVENTION

1. Field of the Invention

The invention relates to a belt drive apparatus and an image forming apparatus.

2. Description of Related Art

In conventional image forming apparatus, such as printers, photocopiers, fax machines, and multifunction printers, or in an electrophotographic printer, for example, the surface of a photosensitive drum is uniformly charged by a charge roller and is exposed by an LED head to form an electrostatic latent image, the electrostatic latent image is developed by a developing unit to form a toner image on the photosensitive drum, the toner image is transferred onto a paper sheet, and the transferred toner image is fixed on the paper sheet.

A conventional electrophotographic printer is equipped with a belt drive apparatus to convey paper sheets to a transferring position located between the photosensitive drum and the transferring unit. The belt drive apparatus includes a drive roller, an idle roller, and an endless belt serving as a belt member stretched by the drive roller and the idle roller. When the drive roller rotates, the endless belt is made to run as the idle roller is driven accordingly, thereby conveying the paper sheet on the endless belt to the transferring position.

While the endless belt of the belt drive apparatus is running, the endless belt sometimes moves in the crosstrack direction of the belt and may snake back and forth in that direction. If this occurs, conveyance of the paper sheet becomes unstable, which causes unsatisfactory transfer of the developer image onto the paper sheet. As a consequence, the transferred image quality is degraded.

To address this problem, the snaking of the endless belt is prevented by providing a pulley at least at one end of either the drive roller or the idle roller (the idle roller, for example).

FIG. 2 is a sectional view illustrating an idle roller of the related art, and FIG. 3 is a perspective view illustrating the idle roller of the related art.

These drawings show idle roller 200, pulley 203 provided at one end of idle roller 200, belt receiving portion 204 of pulley 203, and endless belt 210.

If endless belt 210 moves in its width direction and an edge portion of endless belt 210 is brought into contact with belt receiving portion 204 of pulley 203, endless belt 210 is prevented from moving further in that direction. Accordingly, the snaking of endless belt 210 can be prevented (see, for example, JP 2006-162659A).

SUMMARY OF THE INVENTION

In the belt drive apparatus of JP 2006-162659A, an edge portion of endless belt 210 is brought into contact with a surface of belt receiving portion 204 of pulley 203 (hereafter, that surface is called belt receiving surface s1). Belt receiving surface s1 and the axis of the shaft for idle roller 200 make an angle of 90°. Accordingly, while endless belt 210 is running, the edge portion of endless belt 210 rubs against belt receiving surface s1 both at position Pa where endless belt 210 reaches idle roller 200 (where endless belt 210 starts touching idle roller 200) and at position Pb where endless belt 210 leaves idle roller 200 (where endless belt 210 finishes touching idle roller 200).

Accordingly, at position Pa where endless belt 210 reaches idle roller 200, the edge portion of endless belt 210 receives a force directed outward in the radial direction of pulley 203 whereas at position Pb where endless belt 210 leaves idle roller 200, the edge portion of endless belt 210 receives a force directed inward in the radial direction of pulley 203. Consequently, if, for example, endless belt 210 runs in a direction indicated by arrow A, flexures 212 are generated both at position Pa where endless belt 210 reaches idle roller 200 and at position Pb where endless belt 210 leaves idle roller 200. In particular, at position Pb where endless belt 210 leaves idle roller 200, endless belt 210 is drawn into rotating idle roller 200.

Such flexures 212 are generated every time endless belt 210 makes a full rotation, so that an alternate load is applied to the vicinity of the edge portion of endless belt 210. Accordingly, fatigue failure of endless belt 210, that is, breakage of endless belt 210 caused by the fatigue of the material of endless belt 210, is more likely to occur, and thus the durability of endless belt 210 is impaired.

This problem may be addressed by applying a reinforcement tape to reinforce the edge portion of endless belt 210. However, the adhesive used for the reinforcement tape is likely to be affected by such factors as the temperature and the humidity of the use environment. For example, as the use of the reinforcement tape under high-temperature conditions tends to lower the adherence of the adhesive, the reinforcement tape may be displaced or may be removed from endless belt 210. In addition, it is difficult to properly apply the reinforcement tape to the edge portion of endless belt 210, resulting in higher manufacturing cost for the printer.

A first aspect of the invention is a belt drive apparatus including: a rotatable first roller; a rotatable second roller; a belt member stretched between the first and the second rollers so as to be capable of being conveyed by them; and a restraint member provided on at least one of the two ends of the second roller and including a belt receiving surface to be brought into contact with the edge portion of the belt member. The angle between the belt receiving surface and the axis of the second roller is in the range from 93° to 115°.

According to the first aspect, the lateral pressure that the edge portion of the belt member receives when the edge portion is brought into contact with the restraint member is reduced, and the shear stress generated in the belt member is reduced. Accordingly, material failure of the belt member is prevented.

In addition, a reduction is achieved both in the force directed outwards in the radial direction of the belt receiving surface and received by the belt member at the position where the belt member reaches the second roller and in the force directed inwards in the radial direction of the belt receiving surface and received by the belt member at the position where the belt member leaves the second roller. Accordingly, no flexure occurs in the belt member. Consequently, fatigue failure of the belt member is prevented.

In addition, the belt member is brought into uniform contact with the belt receiving surface. Accordingly, distortion can be prevented from occurring in the edge portion of the belt member.

Consequently, the durability of the belt member is improved.

DETAILED DESCRIPTION OF THE EMBODIMENTS

Figure 1:
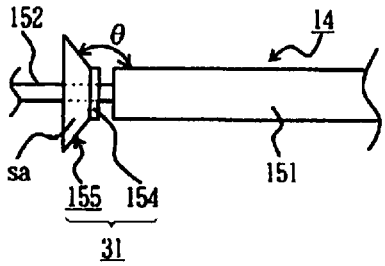
FIG. 1 is a diagram illustrating a principal portion of a transferring unit according to a first embodiment of the invention.
Figure 2:
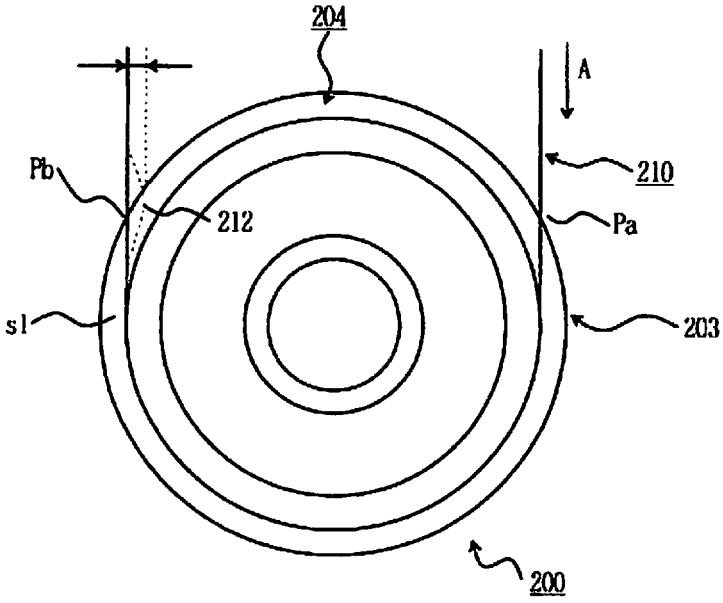
FIG. 2 is a sectional view illustrating a conventional idle roller.
Figure 3:
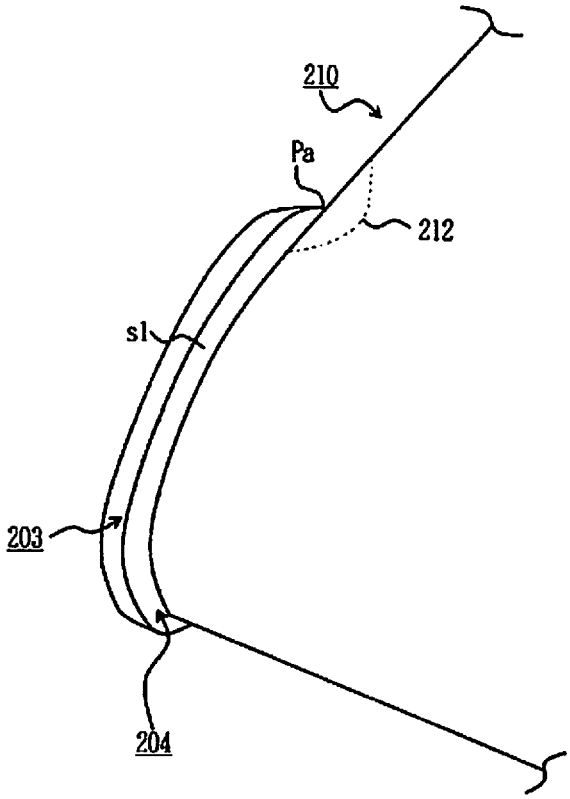
FIG. 3 is a perspective view illustrating the conventional idle roller.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Some embodiments of the invention are described in detail below by referring to the drawings. The following description is given by taking an electrophotographic printer as an exemplar image forming apparatus.

Figure 4:
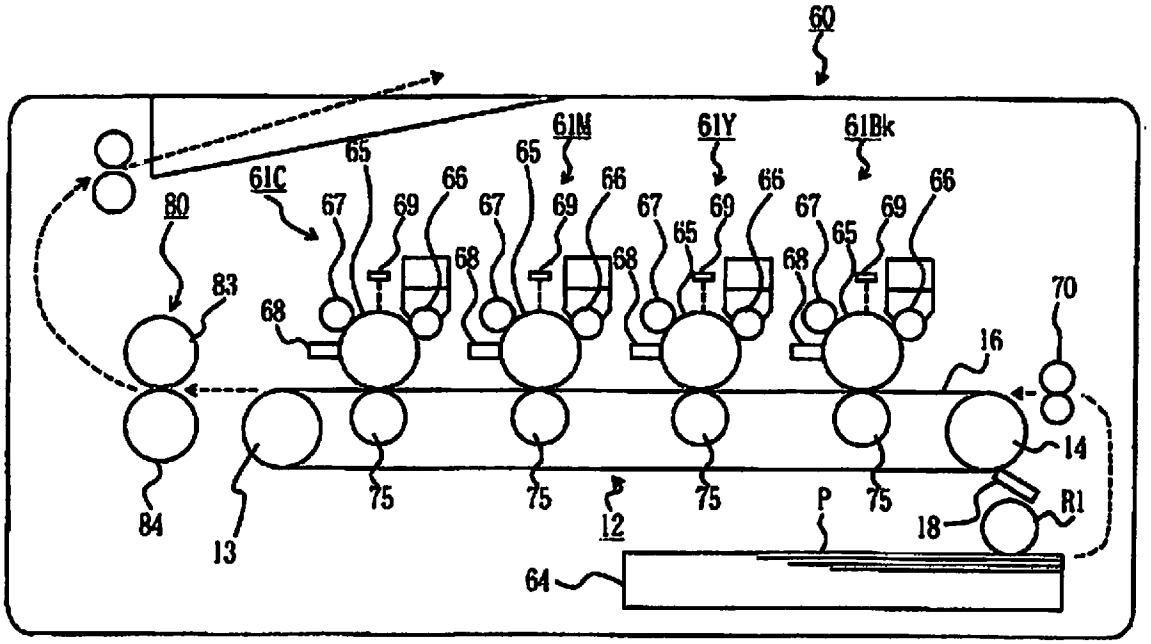
FIG. 4 is a conceptual diagram illustrating a printer according to the first embodiment of the invention.
Figure 5:
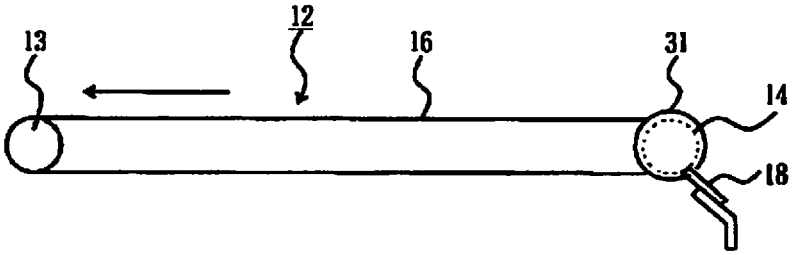
FIG. 5 is a conceptual diagram illustrating the transferring unit according to the first embodiment of the invention.

FIG. 1 is a diagram illustrating a principal portion of a transferring unit according to a first embodiment of the invention. FIG. 4 is a conceptual diagram illustrating a printer according to the first embodiment of the invention. FIG. 5 is a conceptual diagram illustrating the transferring unit according to the first embodiment of the invention.

As FIG. 4 shows, printer 60 includes: a paper-sheet conveyance path (not denoted in the drawings); plural image forming units 61Bk, 61Y, 61M, and 61C; belt-type transferring unit 12; LED heads 69; register rollers 70; fixing unit 80; and the like. The paper-sheet conveyance path serves as a media conveyance path configured to convey the media (i.e., paper sheets P). Image forming units 61Bk, 61Y, 61M, and 61C are configured to form toner images as developer images of their respective colors (black, yellow, magenta, and cyan) in accordance with image data. Transferring unit 12 is provided so as to be opposed to photosensitive drums 65, each of which serves as the image carrier of the corresponding one of image forming units 61Bk, 61Y, 61M, and 61C. Transferring unit 12 thus forms transferring positions for those colors with corresponding photosensitive drums 65. Transferring unit 12 is configured to form color toner images by transferring, consecutively and one upon another, toner images of those colors formed on their respective photosensitive drums 65 onto the medium, that is, paper sheet P. LED heads 69 are provided so as to be opposed respectively to photosensitive drums 65 of image forming units 61Bk, 61Y, 61M, and 61C. Each LED head 69 serves as an exposure apparatus configured to form a latent image, i.e., an electrostatic latent image, by exposing the surface of corresponding photosensitive drum 65 to light. Register rollers 70 serve as conveyor unit configured to feed each paper sheet P that has been fed from paper-sheet cassette 64 and sent out to the paper-sheet conveyance path by feed roller R1 serving as a sheet-feeder. Register rollers 70 feed each paper sheet P to the transferring positions at their respective proper times for image forming units 61Bk, 61Y, 61M, and 61C to form images. Fixing unit 80 serves as a fixing apparatus configured to fix, on paper sheet P, color toner images transferred to paper sheet P at their respective transferring positions. Fixing unit 80 includes heating roller 83 serving as a first rotating body and pressing roller 84 serving as a second rotating body.

All of image forming units 61Bk, 61Y, 61M, and 61C have identical structures. Each of image forming units 61Bk, 61Y, 61M, and 61C includes rotatable photosensitive drum 65; charge roller 67; development roller 66; cleaning blade 68; and the like. Charge roller 67, development roller 66, and cleaning blade 68 are provided in this order in the direction in which photosensitive drum 65 rotates. Charge roller 67 serves as a charging apparatus configured to charge uniformly the surface of photosensitive drum 65. Development roller 66 serves as a developer carrier configured to form a developer image by developing the electrostatic latent image that has been formed by LED head 69. Cleaning blade 68 serves as a first cleaning member included in a cleaning apparatus.

Transferring unit 12 is a belt-type transferring unit, and includes an unillustrated motor, drive roller 13, idle roller 14, endless belt 16, transfer rollers 75, cleaning blade 18, and the like. The motor serves as a driving unit for image transfer. Drive roller 13 serves as a first roller which is coupled to the motor and which is made to rotate by the rotation of the motor. Idle roller 14 serves as a second roller which is driven to rotate by the rotation of drive roller 13. Endless belt 16 is a belt member stretched between drive roller 13 and idle roller 14, being capable of being conveyed in a path around drive roller 13 and idle roller 14, and serving also as a transfer belt. Transfer rollers 75 serve as transfer members rotatably provided inside of the looped endless belt 16 so as to be opposed respectively to photosensitive drums 65. Cleaning blade 18 serves as a second cleaning member which is provided in the vicinity of idle roller 14 so as to be in contact with the outside surface of endless belt 16.

A tension (stretching force) of 6±10% kg is applied to endless belt 16 by an unillustrated tension providing apparatus. If drive roller 13 is made to rotate, idle roller 14 is driven to rotate. Transferring unit 12, tension providing apparatus, and the like together form the belt drive apparatus configured to convey endless belt 16.

Next, the operations of printer 60 are described.

First, paper sheet P supplied from paper-sheet cassette 64 is conveyed by register rollers 70, and is then fed to the transferring positions by endless belt 16. In the meanwhile, in each of image forming units 61Bk, 61Y, 61M, and 61C, the surface of photosensitive drum 65 is electrically charged by charge roller 67, and is then exposed to light by LED head 69 to form an electrostatic latent image. Then, the electrostatic latent image is developed by development roller 66 to form a toner image of the corresponding color on photosensitive drum 65.

Then, at the transferring positions, toner images of their respective colors—black, yellow, magenta, and cyan—are consecutively transferred one upon another onto paper sheet P by transfer rollers 75. Thus, a color toner image is formed on paper sheet P.

Then, paper sheet P with color toner image formed thereon is conveyed to fixing unit 80, where the color toner image on paper sheet P is fixed to paper sheet P by being heated and pressed. Consequently, a color image is formed. Then, paper sheet P is discharged from the main body of printer 60, that is, out of the main body of the apparatus.

The residual toner, as the developer that still remains on each photosensitive drum 65 even after the toner image is transferred onto paper sheet P is scraped off and removed by cleaning blade 68. In addition, toner, foreign objects (e.g., paper dust), and the like that stay on endless belt 16 after the fixing of the image are scraped off and removed by cleaning blade 18.

While endless belt 16 is made to run by the belt drive apparatus, endless belt 16 sometimes moves in the crosstrack direction of endless belt 16 and, consequently, snakes back and forth laterally. If this occurs, conveyance of paper sheet P becomes unstable, which causes unsatisfactory transfer of each toner image onto paper sheet P.

To address this problem, the snaking of endless belt 16 is prevented by providing, at least at one end of either drive roller 13 or idle roller 14, pulley 31 serving as a snaking-restraint member or as a rotating member. In this embodiment, pulley 31 is provided at least at one end of idle roller 14 as shown in FIGS. 1 and 5.

Next, pulley 31 is described.

As FIG. 1 shows, idle roller 14 includes: roller main body 151, which is the main body of idle roller 14; and rotary shafts 152, which serve as the supporting shafts formed so as to extend along the axis of idle roller 14 and to protrude respectively from the two ends of roller main body 151. Rotary shafts 152 are rotatably supported by unillustrated bearing portions, so that idle roller 14 is rotatable. The rotation of drive roller 13 moves endless belt 16, which, in turn, causes idle roller 14 to rotate. To put it differently, along with the rotation of drive roller 13, idle roller 14 is made to rotate by means of endless belt 16.

Pulley 31 is provided on one of two rotary shafts 152 at a specified distance from roller main body 151. In this embodiment, pulley 31 is fixed on rotary shaft 152, but pulley 31 may be provided so as to be incapable of moving in the axial direction relative to rotary shaft 152 but capable of rotating in the rotating direction.

Pulley 31 includes core portion 154 and belt receiving portion 155. Core portion 154 has the same diameter as that of roller main body 151. Belt receiving portion 155 is formed so as to be adjacent to core portion 154, to form a single unit with core portion 154, and to serve as a conically-shaped flange portion. The diameter of belt receiving portion 155 increases at a position farther away from core portion 154.

While endless belt 16 is running, pulley 31 is made to rotate together with idle roller 14. Then, endless belt 16 moves in the crosstrack direction to bring its edge portion into contact with belt receiving portion 155. The contact prevents endless belt 16 from moving further in that direction. Consequently, the snaking of endless belt 16 can be prevented.

In this embodiment, pulley 31 is provided on rotary shaft 152, but pulley 31 may be provided on a different rotating member from any of rotary shafts 152 or on a supporting member to support endless belt 16. In addition, in this embodiment, single pulley 31 is provided at one end of idle roller 14, but two pulleys 31 may be provided respectively at both ends of idle roller 14.

Note that the surface of belt receiving portion 155 of pulley 31 is brought into contact with the edge portion of endless belt 16. The contact surface is referred to as belt receiving surface sa. The angle that belt receiving surface sa makes with the axis of idle roller 14 is denoted by θ (since the axis and the surface of roller main body 151 are parallel to each other, the angle θ is shown in FIG. 1 as the angle that belt receiving surface sa makes with the surface of roller main body 151).

Next, endless belt 16 is described.

In the manufacturing of endless belt 16, it is necessary, from the viewpoint of durability, mechanical characteristics, and the like, to use a material that can restrain, within a certain range, the deformation of endless belt 16 caused by the tension while endless belt 16 is running. In addition, the providing of pulley 31 to prevent endless belt 16 from snaking its way causes the edge portion of endless belt 16 to slide repetitively on belt receiving surface sa. Accordingly, by taking such sliding into consideration, it is necessary to use a material that can make edge portion of endless belt 16 less susceptible to wearing, bending, and cracking.

To this end, in this embodiment, polyamide-imide is used as a main material of endless belt 16.

Carbon black of an appropriate amount is added to polyamide-imide to make polyamide-imide conductive and the mixture is mixed and agitated in an N-methylpyrrolidone solution. The resin material thus obtained is injected into a cylindrical mold. Then, while the mold is rotating, the mold is heated at a temperature that is not lower than 90° C. but is not higher than 120° C. for a predetermined time. Then, the mold is heated at a temperature that is not lower than 200° C. but is not higher than 350° C. for a predetermined time, and then the mold is cooled down. Thus formed in the mold is a raw pipe for the belt with a thickness of 100±10 μm and a circumferential length of 624±1.5 mm. Then, the raw pipe for belt is taken out of the mold and is cut so that each piece has a width of 228±0.5 mm. Thus obtained is endless belt 16 with a thickness of 100±10 μm, a circumferential length of 624±1.5 mm, and a width of 228±0.5 mm.

The rotating speed of the mold is set on the basis of the analysis result of the accuracy of thickness, the thickness itself, and the like of endless belt 16. Specifically, the rotating speed is set not slower than 5 rpm but not faster than 1000 rpm, and is preferably set not slower than 10 rpm but not faster than 500 rpm.

Note that, endless belt 16 may be formed without rotating the mold. For example, a mold with a larger-diameter cylindrical portion and a smaller-diameter cylindrical portion is employed, and a resin material is injected into the gap between the larger-diameter cylindrical portion and the smaller-diameter cylindrical portion. Endless belt 16 may also be formed by applying a resin material onto the external surface of a cylindrical mold, or by immersing a cylindrical mold in a resin material.

In addition, endless belt 16 may be formed by the extrusion molding method, by the inflation molding method, or the like. In these cases, no solvent is needed to form endless belt 16.

The polyamide-imide is a polymer with plural repeating units each of which is formed by binding an amide group and either a single or two imide groups by means of an organic group. Polyamide-imides are classified as aliphatic polyamide-imide or aromatic polyamide-imide depending on whether the organic group is aliphatic or aromatic. In this embodiment, an aromatic polyamide-imide is used. Note that the organic group of the aromatic polyamide-imide includes either a single or two benzene groups.

The polyamide-imide to be used is either one with imide rings that are completely closed or one that is still in the amide acid state with unclosed imide rings. To prevent the dimensional change rate of endless belt 16 from becoming too high, at least 50% or higher, or preferably 70% or higher, of the polyamide-imide that is still in the amide acid state is imidized. The ratio at which the polyamide-imide is imidized, i.e., imidization ratio is calculated, using Fourier-transform infrared spectrophotometer FT-IR (manufactured by PerkinElmer Co., Ltd.), from the intensity ratio between the absorption attributable to imide group (1780 $cm^{-1}$) and the absorption attributable to benzene ring (1510 $cm^{-1}$).

In general, endless belt 16 with a molecular structure that contains more aromatic rings, imide groups, and the like has a higher Young's modulus whereas endless belt 16 with a molecular structure that contains less aromatic rings, imide groups, and the like has a lower Young's modulus.

Note that, some other materials than polyamide-imide can be used for endless belt 16 as a material with which the deformation caused by the tension while endless belt 16 is running is restrained within a certain range. For example, some of the materials that can be used are such resins as polyimide (PI), polycarbonate (PC), polyamide (PA), polyether ether ketone (PEEK), polyvinylidene fluoride (PVdF), and ethylene-tetrafluoroethylene copolymer (ETFE) with a Young's modulus that is not smaller than 2.0 GPa, or preferably, that is not smaller than 3.0 GPa. Each of these resins may be used by itself. Alternatively, a mixture containing mainly these resins may also be used.

The solvent to be used when endless belt 16 is formed is determined appropriately depending upon which material is the main material of endless belt 16. It is preferable to use organic polar solvents, particularly N,N-dimethylacetamides. Some examples of such preferable solvents are N,N-dimethylformamide, N,N-dimethylacetamide, N,N-diethylformamide, N,N-diethylacetamide, dimethylsulfoxide, N-methylpyrrolidone, pyridine, tetramethylene sulfone, and dimethyltetramethylene sulfone. Note that each of these organic polar solvents may be used either by itself or by being mixed with others.

As the carbon black, furnace black, channel black, ketjen black, acetylene black, or the like can be used. Each carbon black can be selected appropriately depending upon the necessary degree of conductivity. In this embodiment, the use of channel black, furnace black, or the like is particularly preferable. Note that carbon blacks subjected to a treatment to prevent oxidation and/or degradation, such as oxidation treatment, grafting treatment, or the like, and carbon blacks with improved dispersibility in the solvent may also be used. Each of these carbon blacks may be used either by itself or by being mixed with others.

The content of the carbon black is appropriately determined depending upon which kind of carbon blacks is to be used. In this embodiment, in view of the necessary mechanical strength and the like, the content of the carbon black is set not lower than 3 wt % of the composition-resin solid content of endless belt 16 but not higher than 40 wt %, preferably not lower than 5 wt % but not higher than 30 wt %, or more preferably not lower than 5 wt % but not higher than 25 wt %.

The necessary specularity of endless belt 16 can be obtained by adjusting appropriately the way of polishing the internal surface of the cylindrical mold.

The toners to be used are fabricated by the emulsion polymerization method and contain styrene-acryl copolymer as the main constituent. The toners to be used contain 9 parts by weight of paraffin wax, have an average particle size of 7 μm and a sphericity of 0.95. In this case, the transfer efficiency can be improved, and it is no longer necessary to apply any release agent to heating roller 83 of fixing unit 80. In addition, the dot reproducibility, the resolution, and the like can be enhanced to produce a sharp image. Consequently, the image quality can be improved.

In addition, a piece of urethane rubber with a rubber hardness JIS A of 72° and with a thickness of 1.5 mm is used as cleaning blade 18. Cleaning blade 18 is set so as to have a linear pressure of 4.3 g/mm against endless belt 16. If cleaning blade 18 is formed with an elastic material such as urethane rubber, cleaning blade 18 can have higher ability of removing toners, foreign objects, and the like that adhere to the surface of endless belt 16 while the structure of printer 60 can be simplified, the size of printer 60 can be reduced, and the manufacturing cost of printer 60 can be reduced. In addition, among various rubber materials, urethane rubber is excellent in hardness, elasticity, wear resistance, mechanical strength, oil resistance, ozone resistance, and the like.

Note that, to secure certain cleaning ability, urethane rubber to be used as cleaning blade 18 as in the case of this embodiment has: a rubber hardness JIS A that is not lower than 60° but not higher than 90°, or preferably that is not lower than 70° but not higher than 85°; a breaking elongation that is not lower than 250% but not higher than 500%, or preferably that is not lower than 300% but not higher than 400%; a permanent elongation that is not lower than 1.0% but not higher than 5.0%, or preferably, that is not lower than 1.0% but not higher than 2.0%; a rebound resilience that is not lower than 10% but not higher than 70%, or preferably that is not lower than 30% but not higher than 50%. Each of these properties, that is, rubber hardness JIS A, breaking elongation, permanent elongation, and rebound resilience, can be measured by their respective measurement methods defined by JIS K6301.

In addition, the linear pressure of cleaning blade 18 against endless belt 16 is not smaller than 1 g/mm but not larger than 6 g/mm, or preferably is not smaller than 2 g/mm but not larger than 5 g/mm. A linear pressure that is smaller than 1 g/mm makes the adhesion of cleaning blade 18 to endless belt 16 insufficient and, accordingly, the cleaning tends to be done poorly. A linear pressure that is larger than 6 g/mm brings cleaning blade 18 and endless belt 16 into plane-to-plane contact with each other, resulting in an excessively large frictional resistance. Accordingly, the pressing force with which cleaning belt 18 is pressed against endless belt 16 becomes larger than the scraping power to remove toners, foreign objects, and the like that adhere to the surface of endless belt 16. Consequently, the cleaning ability is impaired, filming phenomenon occurs, and various other inconveniences such as flipping-up are more likely to occur.

Each of drive roller 13 and idle roller 14 used has a diameter of 25 mm. However, a roller with a diameter that is not smaller than 10 mm but not larger than 50 mm may be used as long as the dimensions and the manufacturing cost of printer 60 permit it.

In the tension providing apparatus, a spring is used to give tension to endless belt 16. In this embodiment, the tension providing apparatus gives a tension of 6±10% kg, but a tension that is not smaller than 2±10% kg but not larger than 8±10% kg may be given by taking account of the material of endless belt 16, the motor used to make endless belt 16 run, and other factors.

In this embodiment, pulley 31 is provided to prevent endless belt 16 from snaking its way. Accordingly, if endless belt 16 moves in the crosstrack direction, and if its edge portion is brought into contact with pulley 31, the edge portion receives a lateral pressure, that is, a certain pressure caused by the reaction force of pulley 31. In this event, if a large shear stress is generated in endless belt 16, endless belt 16 is broken by the stress acting on the material, that is, material failure of endless belt 16 occurs.

In addition, while endless belt 16 is running, the edge portion of endless belt 16 repetitively slides on belt receiving surface sa. Then, the edge portion of endless belt 16 rubs belt receiving surface sa both at a position where endless belt 16 reaches idle roller 14 and at a position where endless belt 16 leaves idle roller 14. In this event, the edge portion of endless belt 16 receives a force directed outward in the radial direction of pulley 31 at the position where endless belt 16 reaches idle roller 14 while the edge portion of endless belt 16 receives a force directed inward in the radial direction of pulley 31 at the position where endless belt 16 leaves idle roller 14, thus generating flexures. Accordingly, stress is concentrated on the vicinity of the edge portion of endless belt 16, or to be more specific, concentrated on the inside area that is away from the edge portion by a distance that is not smaller than 5 mm but not larger than 10 mm, and thus alternate load is exerted. Consequently, fatigue failure of endless belt 16 occurs, so that the durability of endless belt 16 is impaired.

The shear stress and the alternate load becomes larger as the contact area of the edge portion of endless belt 16 with pulley 31 becomes larger and as the contact time of the edge portion of endless belt 16 with pulley 31 becomes longer. Larger shear stress and alternate load makes both material failure and fatigue failure of endless belt 16 more likely to occur.

To address this problem, the durability of endless belt 16 is assessed and determined by varying the angle θ that belt receiving surface sa of pulley 31 makes with the axis of idle roller 14.

Next, the conditions for the durability assessment of endless belt 16 are described.

Figure 6:
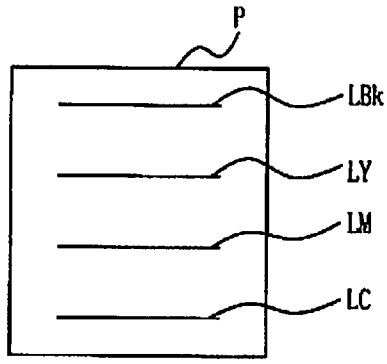
FIG. 6 is a diagram illustrating a print pattern to be used when the durability of an endless belt of the first embodiment of the invention is assessed.

FIG. 6 is a diagram illustrating a print pattern to be used when the durability of the endless belt of the first embodiment of the invention is assessed.

To this end, a printer C5800n manufactured by Oki Data Corporation is used to print repetitively the print pattern shown in FIG. 6 on paper sheets P of A4 size by changing the angle θ. In this event the running speed of endless belt 16, that is, the linear speed of endless belt 16 is set at approximately 90 mm/sec. The print pattern includes horizontal lines of black, yellow, magenta, and cyan LBk, LY, LM, and LC. Each of horizontal lines LBk, LY, LM, and LC is printed with a printing density of 0.5% by assuming an ordinary job of printing text.

The printing is done under the condition of 3P/J (an action of printing three consecutive sheets followed by a 7-second pause). Printing of 60000 sheets and that of 100000 sheets are performed. Note that the printing of 60000 sheets is the rated lifetime of endless belt 16.

Table 1 shows the results of assessing and determining the durability of endless belt 16.

TABLE 1

| | θ (°) | Durability Assessment 60000 (sheet) | Durability Assessment 100000 (sheet) | Determination |
|---|---|---|---|---|
| Example 1 | 75 | 12000 (sheet) broken | — | x |

TABLE 1-continued

| | θ (°) | Durability Assessment 60000 (sheet) | Durability Assessment 100000 (sheet) | Determination |
|---|---|---|---|---|
| Example 2 | 80 | 24000 (sheet) broken | — | x |
| Example 3 | 85 | 45000 (sheet) broken | — | x |
| Example 4 | 93 | 60000 (sheet) good | 100000 (sheet) warpage | Δ |
| Example 5 | 95 | 60000 (sheet) good | 100000 (sheet) good | ○ |
| Example 6 | 100 | 60000 (sheet) good | 100000 (sheet) good | ○ |
| Example 7 | 105 | 60000 (sheet) good | 100000 (sheet) good | ○ |
| Example 8 | 110 | 60000 (sheet) good | 100000 (sheet) warpage | Δ |
| Example 9 | 115 | 60000 (sheet) good | 100000 (sheet) warpage | Δ |

In Table 1, the determination result ○ means that even after the printing of 60000 sheets and that of 100000 sheets, endless belt 16 is not broken and endless belt 16 is still in good condition. The determination result Δ means that minor warpage occurs in the printing of 100000 sheets but no warpage occurs until the printing of 60000 sheets is finished, that is, the state of endless belt 16 has no practical problem. The determination result x means that endless belt 16 is broken before the printing of 60000 sheets is finished.

Table 1 shows that if the angle θ is not smaller than 93° but not larger than 115°, or preferably not smaller than 95° but not larger than 105°, durability of endless belt 16 can be improved.

As the angle θ becomes smaller, the lateral pressure acting on the edge portion of endless belt 16 when the edge portion is in contact with pulley 31 becomes larger, and the shear stress generated in endless belt 16 becomes larger. Consequently, material failure of endless belt 16 becomes more likely to occur.

In addition, as the angle θ becomes smaller, the edge portion of endless belt 16 receives a larger force directed outward in the radial direction of belt receiving surface sa at the position where endless belt 16 reaches idle roller 14, and a larger force directed inward in the radial direction of belt receiving surface sa at the position where endless belt 16 leaves idle roller 14. Consequently, flexures becomes more likely to occur in endless belt 16, and fatigue failure of endless belt 16 becomes more likely to occur.

In contrast, as the angle θ becomes larger, the contact between endless belt 16 and belt receiving surface sa becomes less uniform, so that warpage becomes more likely to occur in the edge portion of endless belt 16.

Accordingly, in this embodiment, the angle θ is not smaller than 93° but not larger than 115°, or preferably not smaller than 95° but not larger than 105°.

In this embodiment, the lateral pressure acting on the edge portion of endless belt 16 when the edge portion is brought into contact with pulley 31 is reduced, and the shear stress generated in endless belt 16 is reduced. Accordingly, material failure of endless belt 16 is prevented.

In addition, of the entire belt receiving surface sa, the edge portion of endless belt 16 is in contact only with the portion that is adjacent to core portion 154. Accordingly, the edge portion of endless belt 16 can receive a smaller force directed outward in the radial direction of belt receiving surface sa at the position where endless belt 16 reaches idle roller 14, and a smaller force directed inward in the radial direction of belt receiving surface sa at the position where endless belt 16 leaves idle roller 14. Consequently, no flexure occurs in endless belt 16, so that fatigue failure of endless belt 16 is prevented.

In addition, endless belt 16 can be brought into uniform contact with belt receiving surface sa. Accordingly, warpage can be prevented from occurring in the edge portion of endless belt 16.

Consequently, the durability of endless belt 16 is improved.

Figure 7:
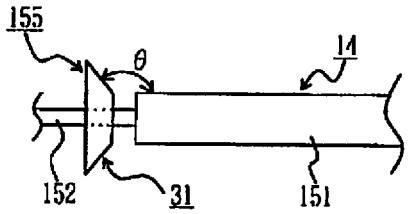
FIG. 7 is a diagram illustrating a pulley according to a modified example of the first embodiment of the invention.

FIG. 7 is a diagram illustrating a pulley according to a modified example of the first embodiment of the invention.

Pulley 31 of this example includes conically-shaped belt receiving portion 155. The diameter of belt receiving portion 155 increases at a position farther away from the smallest-diameter portion that has the same diameter as that of roller main body 151.

Note that the surface of belt receiving portion 155 is brought into contact with the edge portion of endless belt 16. The contact surface is referred to as belt receiving surface sa. The angle that belt receiving surface sa makes with the axis of idle roller 14 is denoted by θ (since the axis and the surface of roller main body 151 is parallel to each other, the angle θ is shown in FIG. 7 as the angle that belt receiving surface sa makes with the surface of roller main body 151).

Also in this case, the angle θ is not smaller than 93° but not larger than 115°, or preferably not smaller than 95° but not larger than 105°.

Next, description is given of a second embodiment of the invention where pulley 31 is provided in the transferring unit. Note that, portions that have identical structures to those in the first embodiment are denoted by the same reference numerals that are used in the first embodiment. The effects of the first embodiment are incorporated in the second embodiment as to the effects of the invention attributable to such identical structures.

Figure 8:
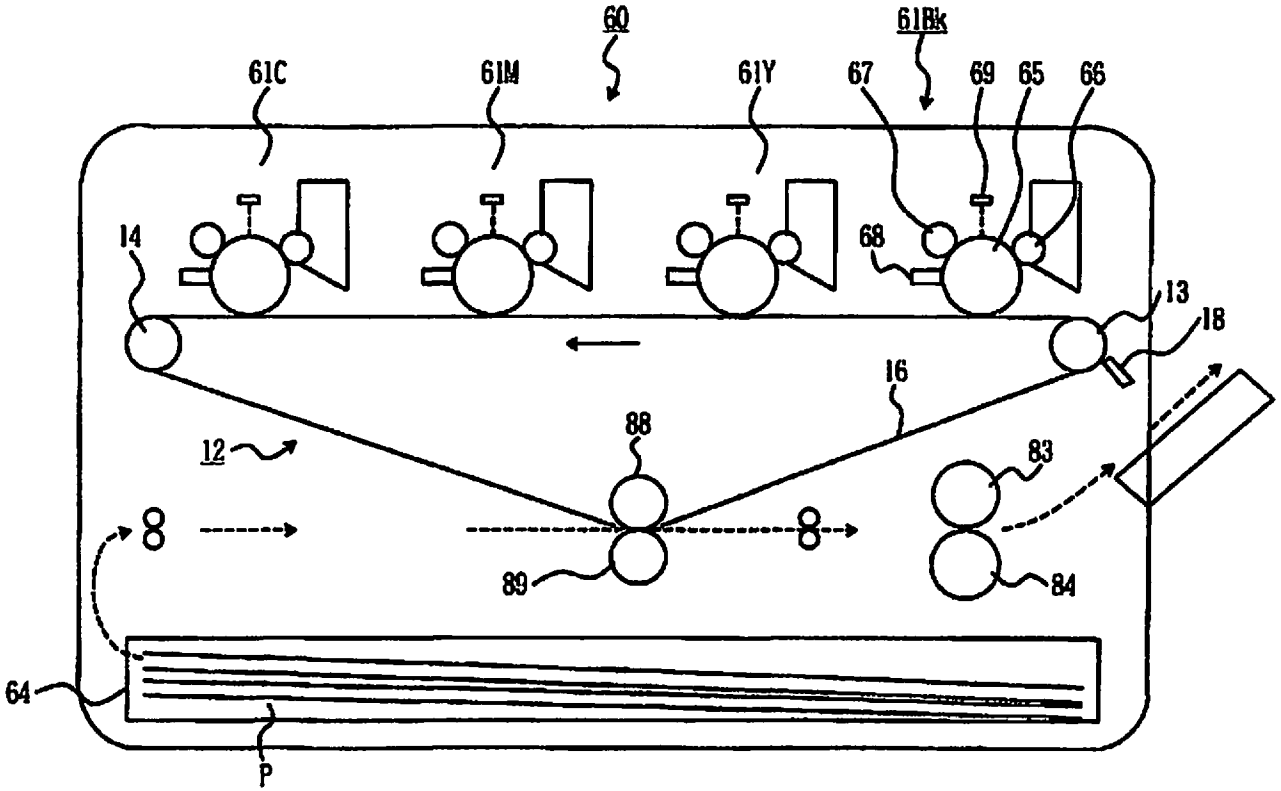
FIG. 8 is a conceptual diagram illustrating a printer according to a second embodiment of the invention.
Figure 9:
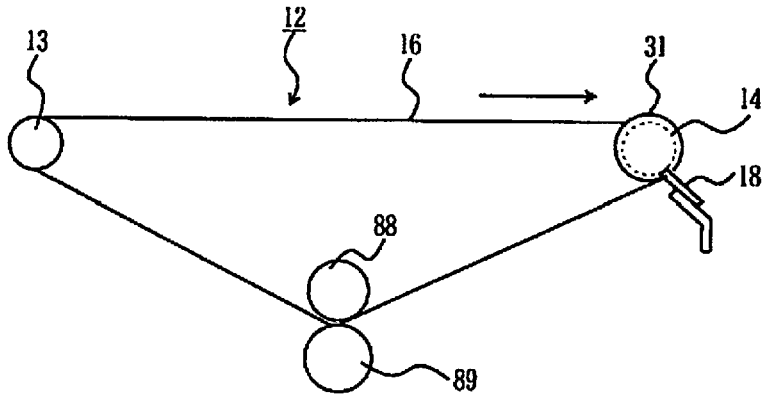
FIG. 9 is a conceptual diagram illustrating a transferring unit according to the second embodiment of the invention.

FIG. 8 is a conceptual diagram illustrating a printer according to the second embodiment of the invention. FIG. 9 is a conceptual diagram illustrating the transferring unit according to the second embodiment of the invention.

In this embodiment, belt-type transferring unit 12 is provided so as to be opposed to photosensitive drums 65 serving as image carriers of image forming units 61Bk, 61Y, 61M, and 61C, respectively.

Transferring unit 12 includes a motor, drive roller 13, idle roller 14, tension roller 88, endless belt 16, transfer roller 89, cleaning blade 18, and the like. The motor serves as the driving unit for image transfer. Drive roller 13 serves as a first roller which is coupled to the motor and which is made to rotate by the rotation of the motor. Idle roller 14 serves as a second roller which is driven to rotate by the rotation of drive roller 13. Tension roller 88 serves as a third roller which is driven to rotate by the rotation of drive roller 13. Endless belt 16 is a belt member stretched by drive roller 13, idle roller 14, and tension roller 88, and made to run in the direction indicated by the arrow. Endless belt 16 serves also as a transfer belt (intermediate transferring body). Transfer roller 89 serves as a transferring-position material rotatably provided outside of looped endless belt 16 so as to be opposed to tension roller 88. Cleaning blade 18 serves as a second cleaning member which is provided in the vicinity of idle roller 14 so as to be in contact with the outside surface of endless belt 16. Tension roller 88, together with transfer roller 89, is capable of moving endless belt 16 in a direction (outwards) so as to separate endless belt 16 away from image forming units 61Bk, 61Y, 61M, and 61C. Tension roller 88 gives endless belt 16 certain tension corresponding to the moving distance. Paper sheet P serving as a medium is conveyed between endless belt 16 and transfer roller 89.

First transferring positions are formed between endless belt 16 and each of photosensitive drums 65 serving as image carriers of image forming units 61Bk, 61Y, 61M, and 61C. A second transferring position is formed between endless belt 16 and transfer roller 89.

In image forming units 61Bk, 61Y, 61M, and 61C, toner images formed as developer images of those colors on their respective photosensitive drums 65 are consecutively transferred one upon another at their respective first transferring positions. Thus a color toner image is formed on endless belt 16. While endless belt 16 is running, the color toner image is sent to the second transferring position, where the color toner image is transferred onto paper sheet P.

Pulley 31 serving as a snaking-restraint member or as a rotating member is provided at least at one end of idle roller 14 to prevent the snaking of endless belt 16.

If endless belt 16 moves in the crosstrack direction, and if the edge portion is brought into contact with pulley 31, the edge portion receives a lateral pressure, that is, a certain pressure caused by the reaction force of pulley 31. In this event, if there are microscopic asperities on the contact surface, that is, on belt receiving surface sa, the edge portion receives an nonuniform lateral pressure. In addition, when endless belt 16 is manufactured by cutting the raw pipe for the belt so that each piece has a width of 228±0.5 mm, microscopic asperities are formed in the edge portion of the piece. As the number of the asperities increases, stress concentration occurs and endless belt 16 is more likely to be dragged by pulley 31 while endless belt 16 slides on pulley 31. Accordingly, a larger shear stress occurs in endless belt 16, and material failure of endless belt 16 occurs.

Next, description is given of a third embodiment of the invention that can prevent, more effectively, the material failure of endless belt 16. Note that, portions that have identical structures to those in the first and the second embodiments are denoted by the same reference numerals that are used in the first and the second embodiments. The effects of the first and the second embodiments are incorporated in the third embodiment as to the effects of the invention attributable to such identical structures.

Figure 10:
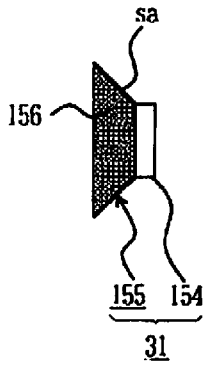
FIG. 10 is a conceptual diagram illustrating a pulley according to a third embodiment of the invention.

FIG. 10 is a conceptual diagram illustrating a pulley according to the third embodiment of the invention.

In this embodiment, belt receiving surface sa serving as the contact surface is coated with a fluorine coating material to form sliding-friction reducing film 156 that reduces the friction with the edge portion of endless belt 16. The fluorine coating material is made of a fluorine containing material having both a low surface energy and a small friction coefficient, being UV-curable, and containing perfluoroalkyl group. The coating can be done first by applying the material with a spray gun to form a thin film and then by irradiating the thin-film coating material with ultraviolet rays with a UV irradiator to cure the coating material.

Some of the materials to be used as the fluorine containing material are tetrafluoroethylene-hexafluoropropylene copolymer (FEP), tetrafluoroethylene-perfluoroalkyl vinyl ether copolymer (PFA), polytetrafluoroethylene (PTFE), and fluoroethylene vinyl ether polymer (FEVE).

The durability of endless belt 16 serving as a belt member such as a transfer belt is assessed and determined by varying the angle θ made by belt receiving surface sa on which sliding-friction reducing film 156 is formed with the axis of idle roller 14 serving as the second roller. The assessment and determination are done under the same assessment conditions and by the same determination method as those in the first embodiment. TRIBOGEAR14FV manufactured by Shinto Scientific Co., Ltd. is used to measure the friction coefficient.

TABLE 2

| | θ (°) | Durability Assessment 60000 (sheet) | Durability Assessment 100000 (sheet) | Determination |
|---|---|---|---|---|
| Example 1 | 85 | 60000 (sheet) good | 82000 (sheet) broken | x |
| Example 2 | 93 | 60000 (sheet) good | 100000 (sheet) good | ○ |
| Example 3 | 95 | 60000 (sheet) good | 100000 (sheet) good | ○ |
| Example 4 | 100 | 60000 (sheet) good | 100000 (sheet) good | ○ |
| Example 5 | 105 | 60000 (sheet) good | 100000 (sheet) good | ○ |
| Example 6 | 110 | 60000 (sheet) good | 100000 (sheet) good | ○ |
| Example 7 | 115 | 60000 (sheet) good | 100000 (sheet) good | ○ |

Table 2 shows that when sliding-friction reducing film 156 is formed on belt receiving surface sa, the setting of the angle θ not smaller than 93° but not larger than 115° can improve the durability of endless belt 16.

Since sliding-friction reducing film 156 formed on belt receiving surface sa coats the microscopic asperities on belt receiving surface sa and has a small friction coefficient, the shear stress generated in endless belt 16 is reduced.

In this embodiment, since sliding-friction reducing film 156 is formed on belt receiving surface sa, the durability of endless belt 16 is improved furthermore.

Next, a fourth embodiment of the invention is described. Note that, portions that have identical structures to those in the first to the third embodiments are denoted by the same reference numerals that are used in the first to the third embodiments. The effects of the first to the third embodiments are incorporated in the fourth embodiment as to the effects of the invention attributable to such identical structures.

Figure 11:
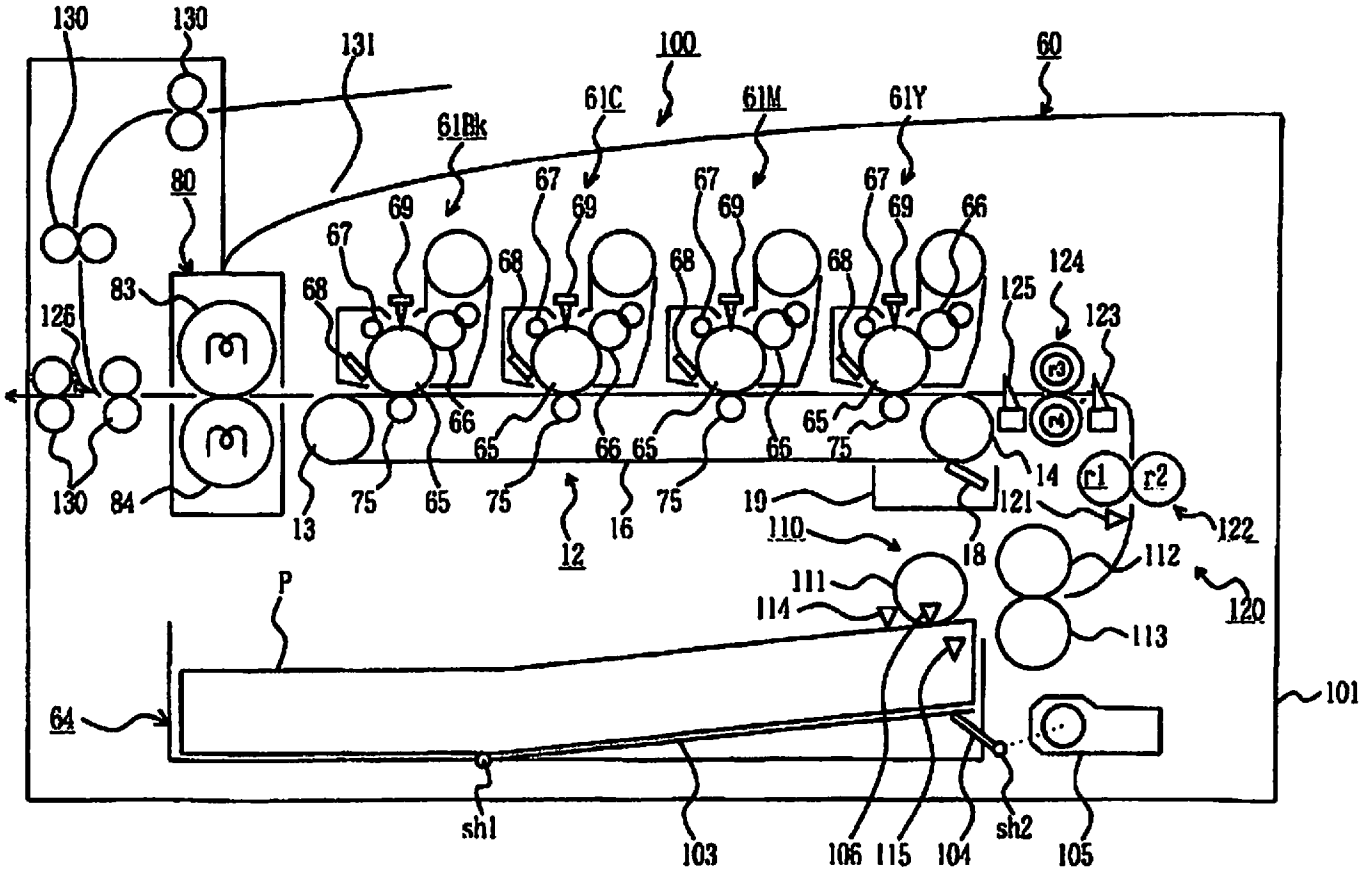
FIG. 11 is a conceptual diagram illustrating a printer according to a fourth embodiment of the invention.

FIG. 11 is a conceptual diagram illustrating a printer according to the fourth embodiment of the invention.

In this embodiment, paper-sheet cassette 64 serving as a media container is provided detachably from apparatus main body 101 of printer 60, and paper sheets P as the media are stored in paper-sheet cassette 64. Media stacking plate 103 is provided in paper-sheet cassette 64 so as to be swingable (pivotable) about swing shaft sh1, and paper sheets P are stacked on media stacking plate 103.

On the sheet-sending side, or in the front-end portion, of paper feeding tray 64, lift-up lever 104 is swingably provided about swing shaft sh2 that is coupled to motor 105 serving as the driving unit for media stacking. Swing shaft sh2 is capable of engaging with or disengaging from motor 105 freely. When paper feeding tray 64 is set in apparatus main body 101, lift-up lever 104 and motor 105 are engaged with each other.

If an unillustrated controller drives motor 105, lift-up lever 104 moves pivotally, the leading end of lift-up lever 104 hits the floor of media stacking plate 103 to raise the front end of media stacking plate 103, and the front end of paper sheet P stacked on media stacking plate 103 is lifted up. Once the front end of paper sheet P is lifted up to a predetermined height, lift-up detector 106 detects paper sheet P and sends a detection signal to the controller. Upon receiving the detection signal, the controller stops motor 105 to stop the pivotal movement of lift-up lever 104.

In addition, media reeling-up unit 110 configured to feed paper sheets P by reeling up paper sheets P one by one is provided in the front-end portion of paper feeding tray 64. Media reeling-up unit 110 includes pick-up roller 111, feed roller 112, and retard roller 113. Pick-up roller 111 is provided so as to be in pressure contact with the front end of paper sheet P that has been raised up to the predetermined height. Pick-up roller 111 serves as a reel-up roller included in a reel-up member to reel-up paper sheets P. Feed roller 112 serves as a feed element provided to separate each of paper sheets P that have been reeled up by pick-up roller 111 from the others. Retard roller 113 serves as a retard element. Feed roller 112 and retard roller 113 form a separator apparatus. Media reeling-up unit 110 includes media-existence detector 114 and remaining-media detector 115. Media-existence detector 114 is adjacent to lift-up detector 106 and detects whether there is or is not any paper sheet P. Remaining-media detector 115 is provided below lift-up detector 106 by a certain distance, and detects the amount of remaining paper sheets P.

Each paper sheet P having been reeled up by media reeling-up unit 110 and then separated from the others by feed roller 112 and retard roller 113 is sent to the conveyor path of first media conveyor unit 120. In first media conveyor unit 120, paper sheet P passes by media sensor 121 serving as a first media detector. After the leading end of paper sheet P is detected by media sensor 121, paper sheet P is sent to conveyor-roller pair 122 serving as a first roller pair including rollers r1 and r2. Upon detecting the leading end of paper sheet P, media sensor 121 sends a detection signal to the controller. Conveyor-roller pair 122 is driven to rotate by an unillustrated register motor serving as a first driving unit.

Subsequently, the paper sheet passes through conveyor-roller pair 122, and then passes by entrance sensor 123 serving as a second media detector. After entrance sensor 123 detects the leading end of paper sheet P, paper sheet P is then sent to register-roller pair 124 serving as a second roller pair including rollers r3 and r4. Register-roller pair 124 corrects the skew of paper sheet P.

Having passed through register-roller pair 124, paper sheet P passes by print sensor 125 serving as a third media detector. After print sensor 125 detects the leading end of paper sheet P, paper sheet P is sent to image forming unit 100.

Note that, entrance sensor 123 is provided near register-roller pair 124 and upstream of register-roller pair 124 in the conveying direction of paper sheet P. Print sensor 125 is provided near register-roller pair 124 and downstream of register-roller pair 124 in the conveying direction of paper sheet P. Upon detecting the leading end of paper sheet P, each of entrance sensor 123 and print sensor 125 sends a detection signal to the controller.

Image forming unit 100 includes: four image forming units 61Y, 61M, 61C, and 61Bk that are arranged in series. In addition, image forming unit 100 includes belt-type transferring unit 12, LED heads 69, and the like. Belt-type transferring unit 12 is provided so as to be opposed to photosensitive drums 65 serving respectively as image carriers of image forming units 61Y, 61M, 61C, and 61Bk. Transferring positions are formed between belt-type transferring unit 12 and each of photosensitive drums 65. Toner images that are formed on photosensitive drums 65 as the developer images of their respective colors are transferred one after another onto paper sheet P as the medium to form a color toner image. LED heads 69 are provided so as to be opposed respectively to photosensitive drums 65, and serve as exposure apparatus configured to expose the surfaces of their respective photosensitive drums 65 to form electrostatic latent images as latent images.

Transferring unit 12 includes a motor, drive roller 13, idle roller 14, endless belt 16, transfer rollers 75, cleaning blade 18, toner box 19, and the like. The motor serves as the driving unit for image transfer. Drive roller 13 serves as a first roller which is coupled to the motor and which is made to rotate by the rotation of the motor. Idle roller 14 serves as a second roller which is driven to rotate by the rotation of drive roller 13. Endless belt 16 is a belt member stretched by drive roller 13 and idle roller 14, being capable of running freely, and serving also as a transfer belt. Transfer rollers 75 serve as transferring-position materials that are rotatably provided inside of looped endless belt 16 so as to be opposed respectively to photosensitive drums 65. Cleaning blade 18 serves as a second cleaning member which is provided in the vicinity of idle roller 14 so as to be in contact with the outside surface of endless belt 16. Toner box 19 serves as a developer storage where the toner as developer scraped off by cleaning blade 18 are deposited and stored.

Tension is applied to endless belt 16 by a tension providing apparatus. If drive roller 13 is made to rotate, idle roller 14 is driven to rotate. Transferring unit 12, the tension providing apparatus, and the like together form the belt drive apparatus configured to drive endless belt 16.

The operation of image forming units 61Y, 61M, 61C, and 61Bk are synchronized with the motion of endless belt 16. Toner images of those colors are transferred, one after another, onto paper sheet P on endless belt 16 to form a color toner image. Paper sheet P with color toner image formed in this way is sent to fixing unit 80 serving as a fixing apparatus.

Fixing unit 80 includes heating roller 83 serving as a first rotating body and pressing roller 84 serving as a second rotating body. In fixing unit 80, color toner image on paper sheet P sent from image forming unit 100 is heated and pressurized to be melted, and thereby the color toner image is fixed on paper sheet P. After that, paper sheet P sent from fixing unit 80 then reaches separator 126 serving as a conveyance switcher configured to switch the discharging direction of each paper sheet P between an upward path and a straight path. Discharge-roller pairs 130 that are provided at predetermined plural positions on the conveyor passage are used to discharge paper sheet P. Paper sheet P is discharged onto stacker portion 131 formed in the top surface of apparatus main body 101 if the discharging direction is upward. If the discharging direction is straight, paper sheet P is discharged onto an unillustrated rear tray formed in a side surface of apparatus main body 101.

Next, the belt drive apparatus is described.

Figure 12:
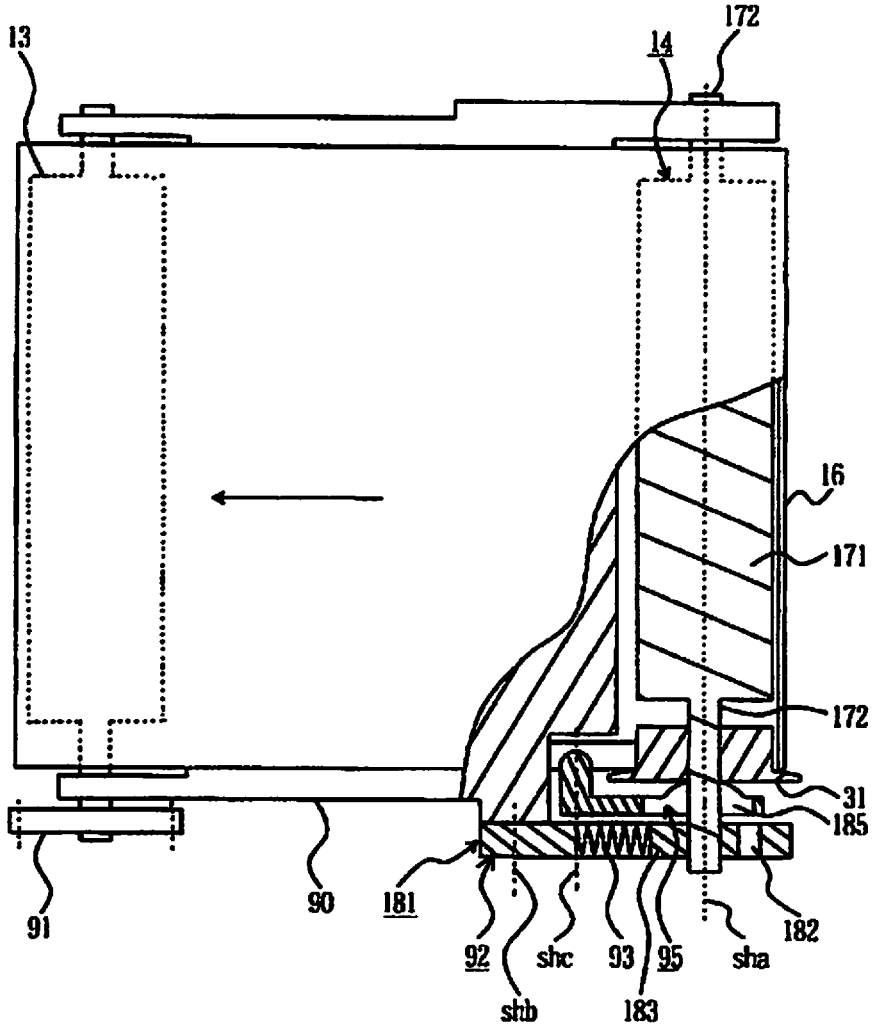
FIG. 12 is a conceptual diagram illustrating a transferring unit according to the fourth embodiment of the invention.
Figure 13:
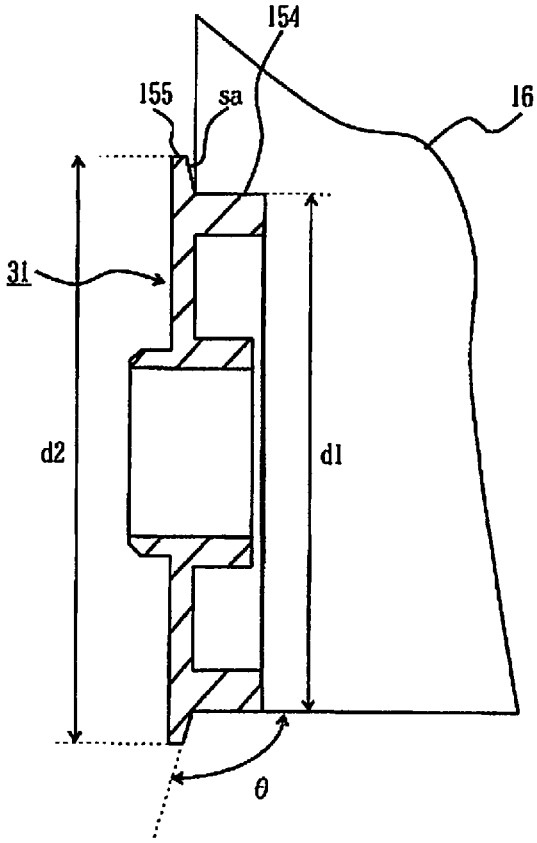
FIG. 13 is a conceptual diagram illustrating a pulley according to the fourth embodiment of the invention.

FIG. 12 is a conceptual diagram illustrating the transfer unit according to the fourth embodiment of the invention. FIG. 13 is a conceptual diagram illustrating a pulley according to the fourth embodiment of the invention.

As FIG. 12 shows, the belt drive apparatus includes belt frame 90, drive roller 13, idle roller 14, endless belt 16, bearing unit 92, pulley 31, roller tilting lever 95, and the like. Belt frame 90 serves as a supporting case. Bearing unit 92 serves as a supporting apparatus configured to support idle roller 14 so that idle roller 14 can rotate relative to belt frame 90 about axis sha. Pulley 31 is a rotating member and serves as a snaking-restraint member. Pulley 31 is provided at least at one end of idle roller 14. In this embodiment, pulley 31 is provided at one end of idle roller 14. Roller tilting lever 95 is provided between pulley 31 and bearing unit 92 so as to be adjacent to pulley 31. Roller tilting lever 95 serves as a shaft-end-position changing apparatus configured to tilt axis sha.

Drive roller 13 is rotatably supported by belt frame 90, and the surface of drive roller 13 is made of a material with a high friction coefficient. Gear 91 serving as a rotation transmitting element is provided on one end of drive roller 13. When the motor is driven, the rotation is transmitted to drive roller 13 via gear 91, and thereby drive roller 13 is made to rotate.

Idle roller 14 includes: roller main body 171, which is the main body of idle roller 14; and rotary shafts 172, which serve as the supporting shafts formed so as to extend along axis sha of idle roller 14 and to protrude respectively from the two ends of roller main body 171.

Endless belt 16 is made of a belt of such a resin as polyamide-imide, and is formed to have a thickness of 0.1 mm.

Bearing unit 92 includes swingable supporting plate 181, bearing 183, spring 93, and the like. Swingable supporting plate 181 is swingable relative to belt frame 90 about axis shb. Slot 182 is formed in swingable supporting plate 181. Bearing 183 is capable of sliding freely in slot 182, and rotatably supports rotary shaft 172. Spring 93 is installed in slot 182, and serves as an urging member to urge bearing 183 in a direction away from drive roller 13. Spring 93 forms the tension providing apparatus, and the urging force of spring 93 generates a tension.

Pulley 31 is made to rotate on rotary shaft 172 together with idle roller 14, and is movable freely relative to roller main body 171 in the axial direction of idle roller 14. Roller tilting lever 95 is adjacent to pulley 31, and is capable of pivoting about axis she that tilts from axis sha. In addition, roller tilting lever 95 holds rotary shaft 172. To this end, hole 185 is formed in roller tilting lever 95, and allows rotary shaft 172 to pass therethrough to hold rotary shaft 172.

Pulley 31 includes core portion 154 and belt receiving portion 155. Core portion 154 has the same diameter d1 as that of roller main body 171. Belt receiving portion 155 is formed so as to be adjacent to core portion 154 and to form a single unit with core portion 154. Belt receiving portion 155 has a conical shape, and serves as a flange portion with a larger outer diameter d2 than that of roller main body 171. The diameter of belt receiving portion 155 increases at a position farther away from core portion 154. In this embodiment the diameter d1 is 24.6 mm whereas the diameter d2 is 28 mm.

Next, the operations of the belt drive apparatus with the above configuration are described.

First, when the rotation of the motor is transmitted via gear 91 to drive roller 13 to make drive roller 13 rotate, endless belt 16 starts running along with the rotation of drive roller 13. If endless belt 16 moves outwards (downwards in FIG. 12) to bring the edge portion of endless belt 16 into contact with pulley 31, pulley 31 is pushed by endless belt 16 and moves outwards to push roller tilting lever 95. Then, roller tilting lever 95 rotates along a circle with axis shc as the center, and tilts axis sha of idle roller 14 to move upwards the end portion on pulley 31 side of idle roller 14. Consequently, the outward movement of endless belt 16 is restricted.

If, in contrast, endless belt 16 moves inwards (upwards in FIG. 12), pulley 31 moves inwards together with roller tilting lever 95. Then, roller tilting lever 95 rotates along a circle with axis shc as the center, and tilts axis sha of idle roller 14 to move downwards the end portion on pulley 31 side of idle roller 14. Consequently, the inward movement of endless belt 16 is restricted.

Belt receiving surface sa is the contact surface in belt receiving portion 155 of pulley 31. The angle that belt receiving surface sa makes with axis sha of idle roller 14 is denoted by θ (since axis sha and the surface of core portion 154, and axis sha and the surface of roller main body 171 are parallel to each other, the angle θ is shown in FIG. 13 as the angle that belt receiving surface sa makes with the surface of core portion 154 and the surface of roller main body 171). The angle θ is not smaller than 93° but not larger than 115°, or preferably not smaller than 95° but not larger than 105°. In this embodiment, the angle θ is 100°.

In this embodiment, the lateral pressure acting on the edge portion of endless belt 16 when the edge portion is brought into contact with pulley 31 is reduced, and the shear stress generated in endless belt 16 is reduced. Accordingly, material failure of endless belt 16 is prevented.

In addition, of the entire belt receiving surface sa, the edge portion of endless belt 16 is in contact only with the portion that is adjacent to core portion 154. Accordingly, the edge portion of endless belt 16 can receive a smaller force directed outward in the radial direction of belt receiving surface sa at the position where endless belt 16 reaches idle roller 14, and a smaller force directed inward in the radial direction of belt receiving surface sa at the position where endless belt 16 leaves idle roller 14. Consequently, no flexure occurs in endless belt 16, so that fatigue failure of endless belt 16 is prevented.

In addition, endless belt 16 can be brought into uniform contact with belt receiving surface sa. Accordingly, warpage is prevented from occurring in the edge portion of endless belt 16.

Consequently, the durability of endless belt 16 is improved.

Next, a fifth embodiment of the invention is described. Note that, portions that have identical structures to those in the first to the fourth embodiments are denoted by the same reference numerals that are used in the first to the fourth embodiments. The effects of the first to the fourth embodiments are incorporated in the fifth embodiment as to the effects of the invention attributable to such identical structures.

Figure 14:
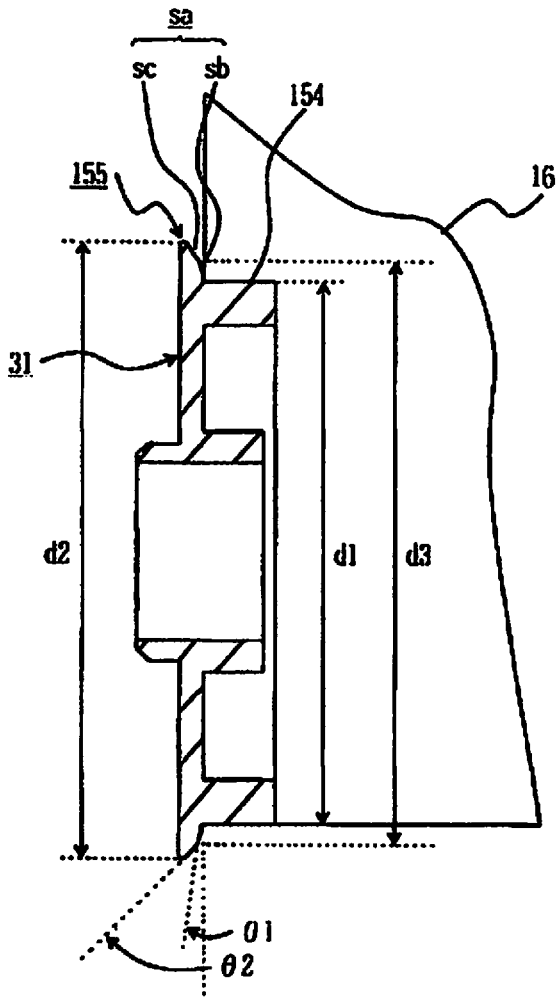
FIG. 14 is a conceptual diagram illustrating a pulley according to a fifth embodiment of the invention.
Figure 15:
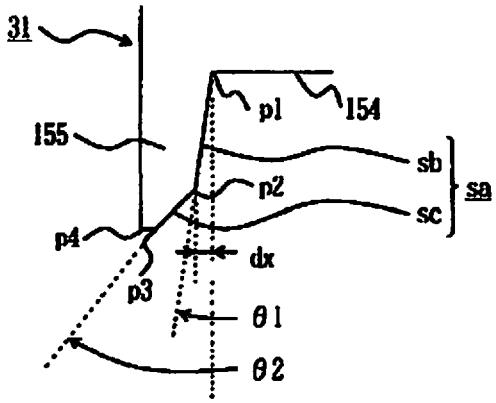
FIG. 15 is an enlarged view illustrating a principal portion of the pulley according to the fifth embodiment of the invention.

FIG. 14 is a conceptual diagram illustrating a pulley according to the fifth embodiment of the invention. FIG. 15 is an enlarged diagram illustrating a principal portion of the pulley according to the fifth embodiment of the invention.

In this embodiment, pulley 31 serving as a snaking-restraint member or as a rotating member includes core portion 154 and belt receiving portion 155. Core portion 154 has the same diameter d1 as that of roller main body 171 (FIG. 12). Belt receiving portion 155 is formed so as to be adjacent to core portion 154 and to form a single unit with core portion 154. Belt receiving portion 155 has an approximately conical shape, and serves as a flange portion with a larger outer diameter d2 than that of roller main body 171. The diameter of belt receiving portion 155 increases at a position farther away from core portion 154. In this embodiment, the diameter d1 is 24.6 mm whereas the diameter d2 is 28 mm.

The angle θ that belt receiving surface sa of belt receiving portion 155 of pulley 31 makes with axis sha of idle roller 14 serving as a second roller increases at a position farther away from core portion 154 and with a larger diameter.

In this embodiment, belt receiving surface sa includes first receiving surface sb with a smaller diameter and second receiving surface sc with a larger diameter. First receiving surface sb extends from point p1 which is on belt receiving surface sa and which is adjacent to core portion 154, to point p2 which is away from point p1 by a predetermined distance dx (in this embodiment dx=0.1 mm) in the axial direction. Second receiving surface sc extends from point p2 to point p3 which is a point on the outer perimeter of belt receiving portion 155. Note that, of all the points on the outer perimeter of belt receiving portion 155, the point that is the farthest from point p1 is referred to as point p4.

The angle that first receiving surface sb makes with axis sha of idle roller 14 is referred to as the angle θ1 whereas the angle that second receiving surface sb makes with axis sha of idle roller 14 is referred to as the angle θ2. The angle θ1 is not smaller than 93° but not larger than 115°, or preferably not smaller than 95° but not larger than 105°. The angle θ2 is larger than the angle θ1. In this embodiment, the angle θ1 is 96° and the angle θ2 is 135°.

Accordingly, the lateral pressure that the edge portion of endless belt 16 receives when the edge portion is brought into contact with pulley 31 is reduced and the shear stress generated in endless belt 16 is reduced. Consequently, material failure of endless belt 16 is prevented.

In addition, since second receiving surface sc is formed outside, in the radial direction, of first receiving surface sb, the edge portion of endless belt 16 is brought into contact with second receiving surface sc at a shallow angle at the position where endless belt 16 reaches idle roller 14, and then endless belt 16 is guided towards first receiving surface sb to stay near point p1.

Accordingly, even if belt receiving surface sa tilts from central axis sha due to manufacture error and/or assemble error, endless belt 16 is guided from second receiving surface sc to first receiving surface sb, so that the snaking of endless belt 16 is reliably prevented.

In addition, at the position where endless belt 16 reaches idle roller 14, the edge portion of endless belt 16 is brought into contact with second receiving surface sc at a shallow angle. Accordingly, no flexure occurs in endless belt 16. Consequently, fatigue failure of endless belt 16 is prevented.

In addition, endless belt 16 can be brought into uniform contact with belt receiving surface sa. Accordingly, warpage is prevented from occurring in the edge portion of endless belt 16.

Consequently, the durability of endless belt 16 is improved.

Note that, the foregoing description of the invention is based on an example of an electrophotographic printer, but the invention is applicable not only to printers but also to multifunction printers, fax machines, and the like.

In addition, the invention is applicable also to such endless belts as photosensitive belts, fixing belts, conveyor belts, and the like.

Note that, the invention is not limited to the foregoing embodiments. Various modifications can be made on the basis of the gist of the invention. Such modifications should not be excluded from the scope of the invention.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A belt drive apparatus comprising:

a rotatable first roller;

a rotatable second roller;

a belt member stretched by the first and the second rollers so as to be capable of being conveyed by the first and the second rollers; and a restraint member provided on at least one of two ends of the second roller and including a belt receiving surface to be brought into contact with an edge portion of the belt member, wherein the belt receiving surface includes a first receiving surface and a second receiving surface located in a radial direction away from the center of the first receiving surface, and the first belt surface and the axis of the second roller make an angle that is not smaller than 93° but not larger than 115°, and a second angle made by the second receiving surface and the axis of the second roller is larger than a first angle made by the first receiving surface and the axis of the second roller.

2. A belt drive apparatus comprising:

a rotatable first roller;

a rotatable second roller including: a roller main body; and a supporting shaft protruding from each end, in an axial direction, of the roller main body;

a belt member stretched by the first and the second rollers so as to be capable of being conveyed by the first and the second rollers; and a restraint member provided on at least one of two ends of the second roller and including a belt receiving surface to be brought into contact with an edge portion of the belt member, wherein the belt receiving surface and the axis of the second roller make an angle that is not smaller than 93° but not larger than 115°, and the restraint member is provided on at least one end, in the axial direction, of the supporting shaft and movable relative to the supporting shaft in the axial direction of the supporting shaft, a shaft-end-position changing apparatus provided adjacent to the restraint member and configured to tilt the axis of the second roller by changing a position of one end of the second roller.

3. The belt drive apparatus according to claim 1, wherein the restraint member is movable with respect to the second roller in the axial direction of the second roller, wherein belt drive apparatus further comprising a shaft-end-position changing apparatus provided adjacent to the restraint member and configured to tilt the axis of the second roller by changing a position of the at least one end of the second roller in response to movements of the restraint member in the axial direction of the second roller.

4. The belt drive apparatus according to claim 2, wherein the angle made by the belt receiving surface and the axis of the second roller increases in an axial direction away from the center of the second roller.

5. The belt drive apparatus according to claim 2, wherein the second roller includes:

a roller main body; and a supporting shaft protruding from each end, in an axial direction, of the roller main body, and the restraint member is provided on at least one end, in the axial direction, of the supporting shaft.

6. The belt drive apparatus according to claim 5, wherein the restraint member is provided movable relative to the supporting shaft in the axial direction of the supporting shaft.

7. The belt drive apparatus according to claim 2, wherein the belt receiving surface includes a sliding-friction reducing film thereon.

8. An image forming apparatus comprising the belt drive apparatus of claim 2.

9. The image forming apparatus according to claim 8, further comprising:

a media conveyance path through which a medium is conveyed;

a developer image forming unit configured to form a developer image;

a transferring unit configured to transfer the developer image formed by the developer image forming unit onto the medium conveyed along the media conveyance path; and a fixing unit provided downstream of the transferring unit in the media conveyance path, and configured to fix the developer image on the medium by heating the medium with the developer image formed thereon.

10. The image forming apparatus according to claim 9, wherein the belt drive apparatus is provided in a portion of the media conveyance path.

11. The image forming apparatus according to claim 9, wherein the belt drive apparatus is provided in the transferring unit.

12. The belt drive apparatus according to claim 2, wherein a gap is provided between the roller and the restraint member in the axial direction of the roller.

13. The belt drive apparatus according to claim 2, further comprising a cleaning blade being in contact with the belt member at a position corresponding to an outer circumferential surface of the second roller, to thereby clean the surface of the belt member as the belt is conveyed.

* * * * *